US006959543B2

(12) United States Patent
Havemann et al.

(10) Patent No.: US 6,959,543 B2
(45) Date of Patent: Nov. 1, 2005

(54) EXHAUST GAS MANIFOLD OF AN EXHAUST SYSTEM FOR AN INTERNAL COMBUSTION ENGINE

(75) Inventors: Kim Havemann, Aidlingen (DE); Christoph Pleuss, Renningen (DE)

(73) Assignee: Ing. h.c.F. Porsche AG, Stuttgart (DE)

( * ) Notice: Subject to any disclaimer, the term of this patent is extended or adjusted under 35 U.S.C. 154(b) by 146 days.

(21) Appl. No.: 10/231,465

(22) Filed: Aug. 30, 2002

(65) Prior Publication Data

US 2003/0056505 A1 Mar. 27, 2003

(30) Foreign Application Priority Data

Sep. 1, 2001 (DE) ..... 101 42 979

(51) Int. Cl.[7] ..... F01N 7/10

(52) U.S. Cl. ..... 60/323; 60/274; 60/313; 285/132.1; 29/890.08

(58) Field of Search ..... 60/274, 322, 323, 60/313; 29/890.08; 285/125.1, 131.1, 132.1

(56) References Cited

U.S. PATENT DOCUMENTS

| | | | | | |
|---|---|---|---|---|---|
| 2,847,819 | A | * | 8/1958 | Muller | 60/323 |
| 4,188,784 | A | * | 2/1980 | Hall | 60/323 |
| 4,656,830 | A | * | 4/1987 | Ohno et al. | 60/323 |
| 5,606,857 | A | | 3/1997 | Harada | |
| 5,761,905 | A | * | 6/1998 | Yamada et al. | 60/322 |
| 5,787,709 | A | | 8/1998 | Watanabe et al. | |
| 5,907,134 | A | | 5/1999 | Nording et al. | |
| 6,122,911 | A | | 9/2000 | Maeda et al. | |
| 6,155,046 | A | * | 12/2000 | Kato et al. | 60/323 |
| 6,199,376 | B1 | * | 3/2001 | Maeda | 60/323 |
| 6,406,066 | B1 | * | 6/2002 | Uegane | 285/124.1 |
| 6,467,261 | B1 | * | 10/2002 | Hisanaga et al. | 60/323 |
| 6,601,572 | B2 | * | 8/2003 | Okamoto | 123/572 |

FOREIGN PATENT DOCUMENTS

| | | | |
|---|---|---|---|
| DE | 2251777 | * | 5/1974 |
| DE | 3740791 | * | 6/1989 |
| DE | 195 26 084 | | 1/1997 |
| EP | 0284466 | * | 9/1988 |
| EP | 0806598 A1 | | 11/1997 |
| EP | 1039107 A2 | | 9/2000 |
| FR | 2203426 | | 5/1974 |
| JP | 57143119 | | 9/1982 |
| JP | 01073119 | | 3/1989 |
| JP | 01138311 | | 5/1989 |
| JP | 09280042 | | 10/1997 |

OTHER PUBLICATIONS

European Search Report date Apr. 22, 2004, European Patent Office.

* cited by examiner

*Primary Examiner*—Thomas Denion
*Assistant Examiner*—Tu M. Nguyen
(74) *Attorney, Agent, or Firm*—Crowell & Moring LLP

(57) ABSTRACT

An exhaust gas manifold of an exhaust system for an internal combustion engine includes a diverging pipe elbow and exhaust pipes. Each exhaust pipe has an end and is connected to the diverging pipe elbow. The ends of the exhaust pipes extend substantially unidirectionally into the pipe elbow. The sections of the exhaust pipes adjacent to the ends are joined and together form a circular cross section. The portions of the exhaust pipes adjacent to the joined sections are separated from each other with a gap.

10 Claims, 3 Drawing Sheets

EXHAUST GAS MANIFOLD OF AN EXHAUST SYSTEM FOR AN INTERNAL COMBUSTION ENGINE

This application claims the priority of German Patent Document No. 101 42 979.7, filed Sep. 1, 2001, the disclosure of which is expressly incorporated by reference herein.

BACKGROUND AND SUMMARY OF THE INVENTION

The invention relates to an exhaust gas manifold of an exhaust system for an internal combustion engine.

EP 0 806 598 A1 discloses an exhaust gas manifold with exhaust pipes, which are connected together two-dimensionally in the adjoined area and otherwise diverge at an angle and do not lie unidirectionally next to one other. Furthermore, U.S. Pat. No. 6,122,911 discloses an exhaust gas manifold, where the exhaust pipes are joined to form a circular segment. The pipes form quadrantal segments, and the walls of these quadrantal segments lie next to each other only at the angular sides and otherwise have a gap in relation to each other.

An object of the invention is to create an improved exhaust gas manifold for an exhaust system of an internal combustion engine, in which the noises, such as the rattling noises, are avoided.

The invention solves this problem with the invention as described and claimed hereinafter.

One of the advantages of the invention is that a noise reduction can be achieved by separating the exhaust pipes from each other, preferably as far as possible, especially when they lie relatively close to each other and are arranged unidirectionally. To this end, the exhaust pipes are arranged unidirectionally in the pipe elbow, and the ends of the pipes form a circular cross section. The free ends of the exhaust pipes are connected together by a defined contact surface, which runs on the peripheral edge. The unidirectional exhaust pipes are separated by a gap. By attaching the exhaust pipes in the pipe elbow and in the fastening flange and by spacing the exhaust pipes between these attachments, rattling noises are reduced or eliminated.

To avoid the noises, the invention provides that the free ends of the exhaust pipes, which empty into the pipe elbow, include quadrantal segments each having a generally triangular configuration. Each pipe end has a relatively narrow edge, which projects outwardly with respect to the rest of the exhaust pipes, thus resulting in a gap between the exhaust pipes. The goal is achieved that the exhaust pipes lie side by side over a relatively small area (also defined at different temperatures) only at the edge of the pipe, and the pipes are separated from each other slightly by a gap. The edges of the pipes that lie side by side are either designed flat or has mating beads.

To avoid sympathetic vibrations in the pipe elbow, the pipe elbow has an internal pipe elbow, which is spaced apart from the external pipe of the pipe elbow and in which the edges of the free ends of the exhaust pipes are recessed. Between the external and internal pipes of the pipe elbow there is a ring or a wire mesh ring in the area of the edge. This design of the pipe elbow and of the free ends of the exhaust pipes significantly reduces the generation of noises, because the pipes do not directly contact the external pipe of the pipe elbow. The edge on the free end of the exhaust pipes has a direct connection to the external pipe by the pipe mesh ring.

The exhaust pipes are arranged so as to lie freely with a spacing gap and in particular in such a manner that the exhaust pipes, held by a fastening flange on the engine side, are connected in the exhaust gas manifold housing by a sliding connection to the continuing exhaust pipes and that the exhaust pipes are arranged so as to lie freely over the edge from the fastening flange up to the uptake in the pipe elbow. The sliding connection between the exhaust pipes in the housing of the exhaust gas manifold accommodates thermal expansion, and any vibrations of the exhaust pipes are reduced due to the friction between the connected pipes.

Other objects, advantages and novel features of the present invention will become apparent from the following detailed description of the invention when considered in conjunction with the accompanying drawings.

DETAILED DESCRIPTION OF THE DRAWINGS

Figure 1:
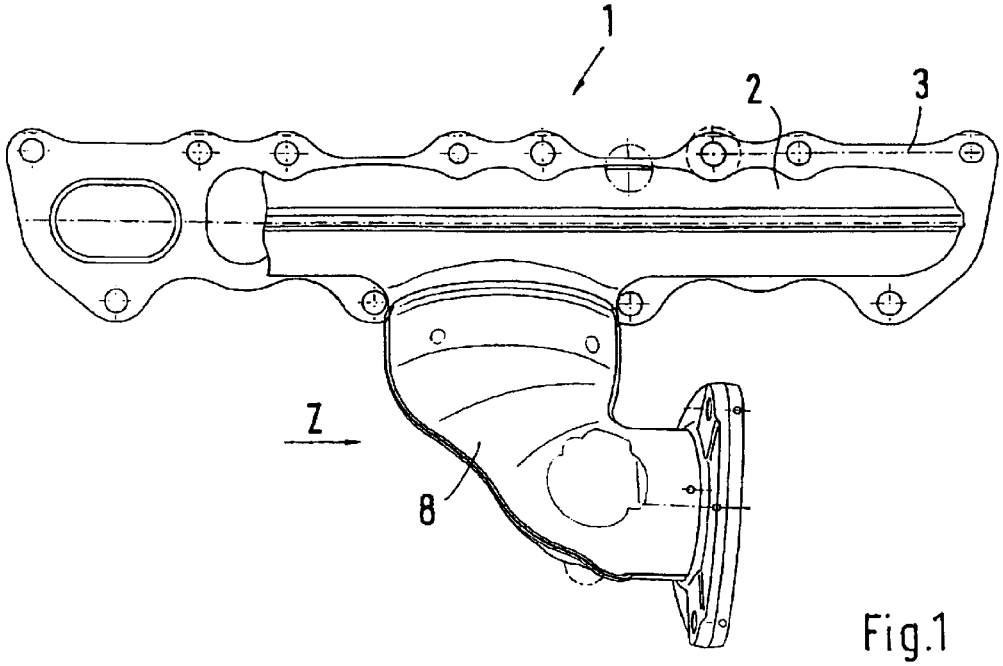
FIG. 1 is a view of an exhaust gas manifold with fastening flange and pipe elbow.
Figure 2:
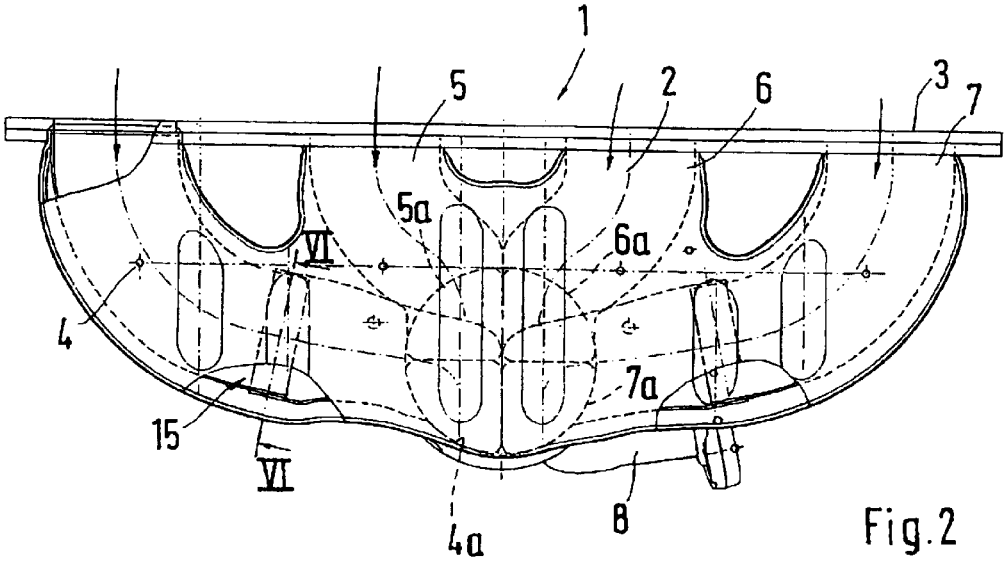
FIG. 2 is a top view of the exhaust gas manifold, according to FIG. 1, with internal exhaust pipes.

As shown in FIGS. 1 and 2, an exhaust gas manifold 1 of an exhaust system for an internal combustion engine comprises an exhaust gas manifold housing 2 with an engine-side fastening flange 3 and exhaust pipes 4 to 7, disposed in or connected to the housing 2, for one half of an eight cylinder engine. A pipe elbow 8 is attached to the housing 2 and to the other exhaust pipes 4*a* to 7*a*.

Figure 3:
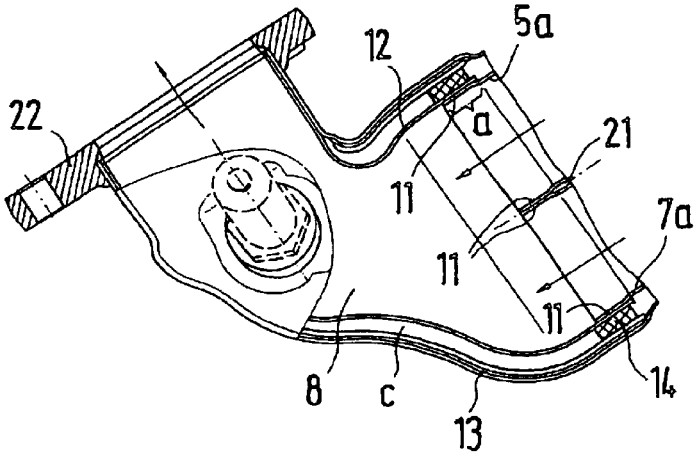
FIG. 3 is a sectional view of the pipe elbow along the line III—III of FIG. 4.
Figure 4:
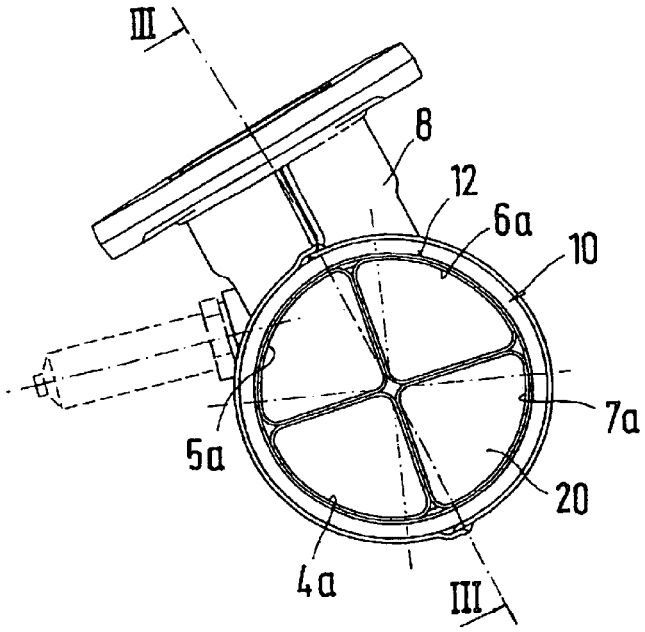
FIG. 4 is a sectional view of the pipe elbow with connected exhaust pipes, according to line IV—IV of FIG. 5.

As shown in FIGS. 3 and 4, the exhaust pipes 4 to 7 and 4*a* to 7*a* extend from the fastening flange 3 at the engine to the input opening 10 in the pipe elbow 8, where they are held with these free ends by a raised flat edge 11 in an internal pipe 12.

Figure 5:
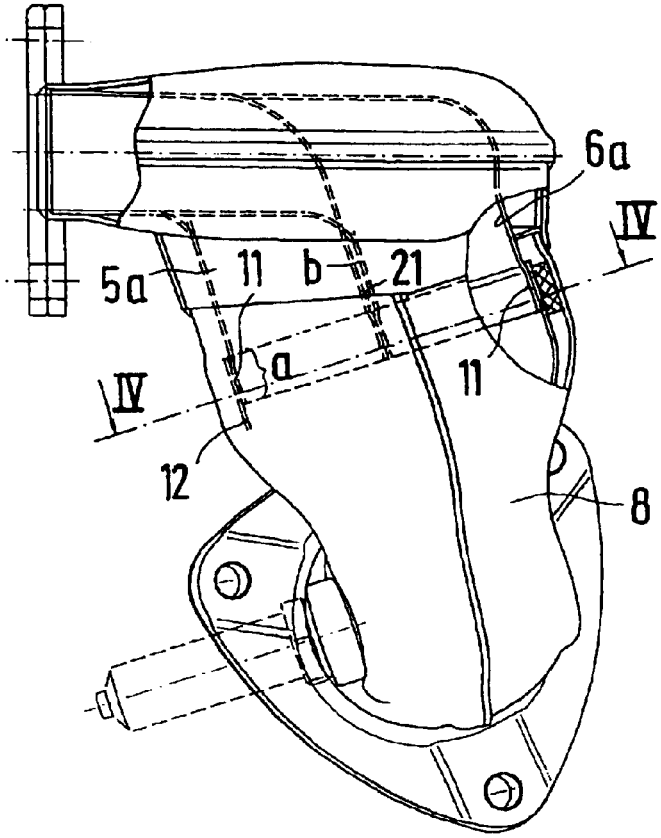
FIG. 5 is a view of the pipe elbow, seen in the direction of the arrow Z of FIG. 1.

As shown in FIG. 4 in conjunction with FIGS. 3 and 5, the edge 11 has a negligible width a and projects over the remaining pipe cross section of the exhaust pipes 4*a* to 7*a*, so that the adjoining, unidirectional areas of the exhaust pipes has a gap 21 in relation to each other. The width of the gap 21 is equal to "b."

The free ends of the exhaust pipes 4*a* to 7*a* form quadrantal segments 20 and together form a circular opening in the cross section. These quadrantal segments 20 have the edge 11, which has, for example, a width "a" equal to approximately 5 mm. The gap 21 between the exhaust pipes 4*a* to 7*a* is approximately b=2 mm. In general, the edge and gap may each have any suitable values.

The gap between the external pipe 13 of the pipe elbow 8 and the internal pipe 12 is a distance c. The internal pipe extends together with the external pipe 13 to as far as the flange 22. Between the external pipe 13 and the internal pipe 12 there is a spacing ring or a so-called wire mesh ring 14 in the region of the edge 11.

Figure 6:
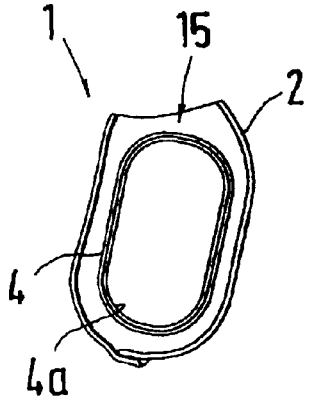
FIG. 6 is a sectional view along the line VI—VI of FIG. 2 of a sliding seat of the exhaust pipes.

The engine-side exhaust pipes 4 to 7 are connected to the flange 3, as shown in FIG. 2, and are connected to the adjoining, other exhaust pipes 4*a* to 7*a* with a sliding seat connection 15. For this connection, the exhaust pipes 4*a* to 7*a* are slid over the corresponding exhaust pipes 4 to 7, as shown in FIG. 6. The exhaust pipes 4 to 7 and 4*a* to 7*a* are separated from each other over the edge 11 in the internal pipe 12 in the fastening flange 3 up to the connection in the pipe elbow 8. Or they are laid at a distance to the wall in the housing 2.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. An exhaust gas manifold of an exhaust system for an internal combustion engine, the manifold comprising:

a diverging pipe elbow; and exhaust pipes each having an end and being connected to the diverging pipe elbow, wherein the ends of the exhaust pipes extend substantially unidirectionally into the pipe elbow, wherein sections of the exhaust pipes adjacent to the ends are joined and together form a circular cross section, and wherein portions of the exhaust pipes adjacent to the joined sections are separated from each other with a gap, wherein the pipe elbow includes an external pipe and an internal pipe disposed within the external pipe and spaced apart from the external pipe, and wherein the pipe elbow includes a wire mesh ring disposed between the external pipe and the internal pipe near the end of the pipe elbow.

2. Exhaust gas manifold of an exhaust system for an internal combustion engine with a diverging pipe elbow, into which empty the exhaust pipes, which are connected on the engine side, and are held together in a segment of the pipe elbow and are held on the end side in said pipe elbow, wherein the exhaust pipes are arranged unidirectionally in the pipe elbow, and their end sides form altogether a circular cross section, where, on the one hand, the free ends of the exhaust pipes are connected together by a defined edge-sided contact surface with a width; and, on the other hand, the unidirectional exhaust pipes are separated from each other with a gap over the continued course, wherein an internal pipe elbow is spaced apart from an external pipe of the pipe elbow; wherein the edges of the free ends of the exhaust pipes are recessed; and wherein between the external pipe and the pipe elbow there is a wire mesh ring in the area of the edges.

3. An exhaust gas manifold of an exhaust system for an internal combustion engine, the manifold comprising:

a diverging pipe elbow; and exhaust pipes each having an end and being connected to the diverging pipe elbow, wherein the ends of the exhaust pipes extend substantially unidirectionally into the pipe elbow, wherein sections of the exhaust pipes adjacent to the ends are joined and together form a circular cross section, and wherein portions of the exhaust pipes adjacent to the joined sections are separated from each other with a gap, wherein the exhaust pipes are a first set of exhaust pipes, wherein the exhaust gas manifold further comprises a second set of exhaust pipes, and each exhaust pipe of the second set is connected to one of the exhaust pipes of the first set with a sliding connection.

4. Exhaust gas manifold of an exhaust system for an internal combustion engine with a diverging pipe elbow, into which empty the exhaust pipes, which are connected on the engine side, and are held together in a segment of the pipe elbow and are held on the end side in said pipe elbow, wherein the exhaust pipes are arranged unidirectionally in the pipe elbow, and their end sides form altogether a circular cross section, where, on the one hand, the free ends of the exhaust pipes are connected together by a defined edge-sided contact surface with a width; and, on the other hand, the unidirectional exhaust pipes are separated from each other with a gap over the continued course, wherein in the exhaust gas housing the other exhaust pipes, which are held by a fastening flange on the engine side, are connected to the continuing exhaust pipes by means of a sliding seat; and wherein the exhaust pipes lie freely over the edge from the fastening flange up to the uptake in the pipe elbow.

5. An exhaust gas manifold of an exhaust system for an internal combustion engine, the manifold comprising:

a diverging pipe elbow; and exhaust pipes each having an end and being connected to the diverging pipe elbow, wherein the ends of the exhaust pipes extend substantially unidirectionally into the pipe elbow, wherein sections of the exhaust pipes adjacent to the ends are joined and together form a circular cross section, and wherein portions of the exhaust pipes adjacent to the joined sections are separated from each other with a gap, wherein the ends of the exhaust pipes each have a generally triangular configuration and each form a quarter of the circular cross section, wherein the section of each exhaust pipe adjacent to the end of the exhaust pipe extends radially outwardly with respect to the portion of the exhaust pipe adjacent to the section, wherein the width of the section of each exhaust pipe adjacent to the end of the exhaust pipe is approximately 5 mm, and the gap between the exhaust pipes is approximately 2 mm, and wherein the pipe elbow includes an external pipe and an internal pipe disposed within the external pipe and spaced apart from the external pipe, and wherein the pipe elbow includes a wire mesh ring disposed between the external pipe and the internal pipe near the end of the pipe elbow.

6. The exhaust gas manifold of claim 5, wherein the exhaust pipes are a first set of exhaust pipes, wherein the exhaust gas manifold further comprises a second set of exhaust pipes, and each exhaust pipe of the second set is connected to one of the exhaust pipes of the first set with a sliding connection.

7. Exhaust gas manifold of an exhaust system for an internal combustion engine with a divering pipe elbow, into which empty the exhaust pipes, which are connected on the engine side and are held together in a segment of the pipe elbow and are held on the end side in said pipe elbow, wherein the exhaust pipes are arranged unidirectionally in the pipe elbow, and their end sides form altogether a circular cross section, where, on the one hand, the free ends of the exhaust pipes are connected together by a defined edge-sided contact surface with a width; and, on the other hand, the unidirectional exhaust pipes are separated from each other with a gap over the continued course, wherein the free ends, which empty into the pipe elbow and belong to the exhaust pipes, are designed triangular as quadrantal segments; and each pipe end exhibits an edge, which protrudes outwardly with respect to the rest of the area of the exhaust pipe; and thus the gap is formed between the exhaust pipes, wherein the edge exhibits a width of approximately 5 mm; and the gap between the exhaust pipes has a dimension of approximately b=2 mm, wherein an internal pipe elbow is spaced apart from an external pipe of the pipe elbow;

wherein the edges of the free ends of the exhaust pipes are recessed; and wherein between the external pipe and the pipe elbow there is a wire mesh ring in the area of the edges.

8. Exhaust gas manifold of claim 7 wherein in the exhaust gas housing the other exhaust pipes, which are held by a fastening flange on the engine side, are connected to the continuing exhaust pipes by means of a sliding seat; and wherein the exhaust pipes lie freely over the edge from the fastening flange up to the uptake in the pipe elbow.

9. The method of making an exhaust gas manifold, the method comprising:

extending the ends of exhaust pipes of the exhaust gas manifold substantially unidirectionally into a pipe elbow of the exhaust gas manifold;

joining sections of the exhaust pipes adjacent to the ends to form a circular cross section;

separating portions of the exhaust pipes adjacent to the joined sections from each other with a gap;

disposing each internal pipe of the pipe elbow within an external pipe of the pipe elbow;

spacing the internal pipe from the external pipe; and disposing a wire mesh ring between the external pipe and the internal pipe near the end of the pipe elbow.

10. The method of claim 9, further comprising connecting each exhaust pipe of a second set of the exhaust gas manifold to one of the exhaust pipes of a first set of the exhaust gas manifold with a sliding connection.

* * * * *